US006581314B2

(12) United States Patent
Valiulis

(10) Patent No.: US 6,581,314 B2
(45) Date of Patent: Jun. 24, 2003

(54) LABEL HOLDER WITH SELECTIVELY ATTACHABLE SIGN HOLDER

(75) Inventor: Stanley C Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 16 days.

(21) Appl. No.: 09/872,115

(22) Filed: Jun. 1, 2001

(65) Prior Publication Data

US 2002/0178630 A1 Dec. 5, 2002

(51) Int. Cl.[7] ..... G09F 3/00; G09F 3/20

(52) U.S. Cl. ..... 40/642.01; 40/651; 40/654.01

(58) Field of Search ..... 40/5, 642.01, 642.02, 40/649, 651, 654.01, 661, 661.03; 211/57.1, 59.1; 248/214

(56) References Cited

U.S. PATENT DOCUMENTS

| | | | | | |
|---|---|---|---|---|---|
| 1,768,715 | A | * | 7/1930 | Hopp et al. | 40/649 X |
| 3,912,084 | A | | 10/1975 | Valiulis | |
| 4,044,485 | A | * | 8/1977 | Hopp | 40/651 |
| 4,688,341 | A | * | 8/1987 | Castel | 40/661.06 X |
| 4,850,557 | A | | 7/1989 | Valiulis | |
| 5,231,779 | A | | 8/1993 | Valiulis et al. | |
| 5,236,163 | A | | 8/1993 | Valiulis | |
| 5,419,066 | A | * | 5/1995 | Harnois et al. | 40/649 X |
| 5,967,343 | A | * | 10/1999 | Dufresne | 211/86.01 |
| 5,996,264 | A | * | 12/1999 | Nagel | 40/649 |
| 6,026,603 | A | * | 2/2000 | Kump et al. | 40/661.03 |
| 6,119,990 | A | * | 9/2000 | Kump et al. | 40/661.03 X |
| 6,189,248 | B1 | * | 2/2001 | Nagel et al. | 40/661.03 |
| 6,266,906 | B1 | * | 7/2001 | Nagel | 40/661.03 |

FOREIGN PATENT DOCUMENTS

| | | | | |
|---|---|---|---|---|
| GB | 2019630 | * | 10/1979 | 40/651 |

OTHER PUBLICATIONS

Southern Imperial, Inc. 1999 catalog, 3 pages total.

* cited by examiner

*Primary Examiner*—Brian K. Green
(74) *Attorney, Agent, or Firm*—Leydig, Voit & Mayer, Ltd.

(57) ABSTRACT

A product information display apparatus is provided to display primary and secondary product information. The display apparatus generally comprises a label holder and a sign holder. The label holder includes a sleeve having front and rear walls defining an interior pocked sized to receive a label having primary product information. The sign holder is structured for selective attachment to the label holder to position a sign adjacent the front wall of the sleeve, the sign having secondary product information. Preferably, the sign holder has a general C-shape with the free ends of the C-shape defining a throat sized smaller than a height of the sleeve. Also, the general C-shape is preferably defined by a pair of rear walls connected by a front wall, the front wall spaced from the pair of rear walls a distance similar to a thickness of the sleeve to securely position the sign.

12 Claims, 9 Drawing Sheets

LABEL HOLDER WITH SELECTIVELY ATTACHABLE SIGN HOLDER

FIELD OF THE INVENTION

The present invention relates generally to marketing display devices, and more particularly relates to label holders and sign holders.

BACKGROUND OF THE INVENTION

As is well known, a variety of hangers, shelving, racks and similar merchandise supports are used to support and display merchandise for convenient viewing and access by customers. Likewise, numerous types of product information display apparatus, such as label holders, are used to display product information such as name, quantity, price, etc. For example, hangers such as peg hooks and scanning hooks are commonly used to display merchandise, and most hangers are also adapted to display a label, usually with a label holder built into or attached to an end of the hanger.

As is also well known, new products are introduced quite frequently, which requires the use of existing merchandise supports and information displays for these new products. Furthermore, today's marketplace often dictates that product information changes on a regular basis, requiring frequent modification of the product information. Likewise, additional or supplemental information (usually short-term information) such as a special sale or the like must also be displayed and modified. For these reasons, labels are frequently replaced with new labels displaying new, more current information, as well as sale information. Therefore, there exists a need to provide a simple and economical way to display modified merchandise information, including additional or supplemental information.

BRIEF SUMMARY OF THE INVENTION

In light of the above, it is a general aim of the present invention to provide a product information display apparatus that securely displays product information that can be easily updated or modified.

In that regard, it is also an object of the present invention to provide a product information display apparatus that can easily display primary product information as well as secondary or supplemental product information.

It is another object of the present invention to provide a product information display apparatus that can selectively display secondary product information.

It is a further object of the present invention to provide a product information display apparatus that can be adapted for different sizes of merchandise supports.

In accordance with these objects, the present invention provides a product information display apparatus for use with a merchandise support to display primary and secondary product information. The display apparatus generally comprises a label holder and a sign holder. The label holder includes a sleeve having front and rear walls defining an interior pocked sized to receive a label having primary product information. A mounting member is connected to the rear wall of the sleeve and is structured for attachment to the merchandise support. The sign holder is structured for selective attachment to the label holder to position a sign adjacent the front wall of the sleeve, the sign having secondary product information. Preferably, the sign holder has a general C-shape with the free ends of the C-shape defining a throat sized smaller than a height of the sleeve.

Also, the general C-shape is preferably defined by a pair of rear walls connected by a front wall, the front wall spaced from the pair of rear walls a distance similar to a thickness of the sleeve to securely position the sign.

According to more detailed aspects, the label holder further includes a bridge linking the sleeve and mounting member, the bridge having a height less than the mounting member and the sleeve. The bridge also serves to define a well that is sized to receive the sign holder. The well typically receives at least a portion of the free ends of the sign holder. Preferably the well includes an upper well and a lower well, the upper well sized to receive the free end of the upper rear wall and the lower well sized to receive the free end of the lower rear wall.

According to another embodiment of the present invention a product information display apparatus is provided for use with a merchandise support to display primary and secondary product information. The display apparatus generally comprises a label holder and a sign holder. The label holder includes a sleeve having front and rear walls defining an interior pocked sized to receive a label having primary product information. A mounting member is connected to the rear wall of the sleeve and is structured for attachment to the merchandise support. The sign holder is structured for selective attachment to the label holder to position a sign adjacent the front wall of the sleeve, the sign having secondary product information. The sign holder has a pair of rear walls connected by a front wall, free ends of the rear walls being spaced apart to define a throat. The rear wall of the sleeve and the mounting member have clearance to receive the free ends of the rear walls. According to more detailed aspects, the front wall is spaced from the pair of rear walls a distance similar to a thickness of the sleeve. Preferably, the clearance is defined by a bridge linking the label holder and mounting member, the bridge defining a well. Also preferable, the well is sized to receive the free ends of the sign holder.

In accordance with the present invention a unique label holder is also provided. The label holder generally comprises a sleeve having front and rear walls defining an interior pocked sized to receive a label. A mounting member is attached to the rear wall of the sleeve and is structured for attachment to the merchandise support. A bridge links the label holder and mounting member. Preferably, the bridge has a height less than the mounting member and sleeve to define a well. According to more detailed aspects, the mounting member includes a plurality of slots, each slot of a different size to accommodate differently sized merchandise supports. Preferably, each slot is generally L-shaped and are vertically spaced in incremental size. The interior pocket of the sleeve may be upwardly opening and the rear wall will include an upwardly opening slot corresponding to the pocket. Alternatively, the interior pocket of the sleeve may be laterally opening and the rear wall will include a laterally opening slot corresponding with the pocket.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
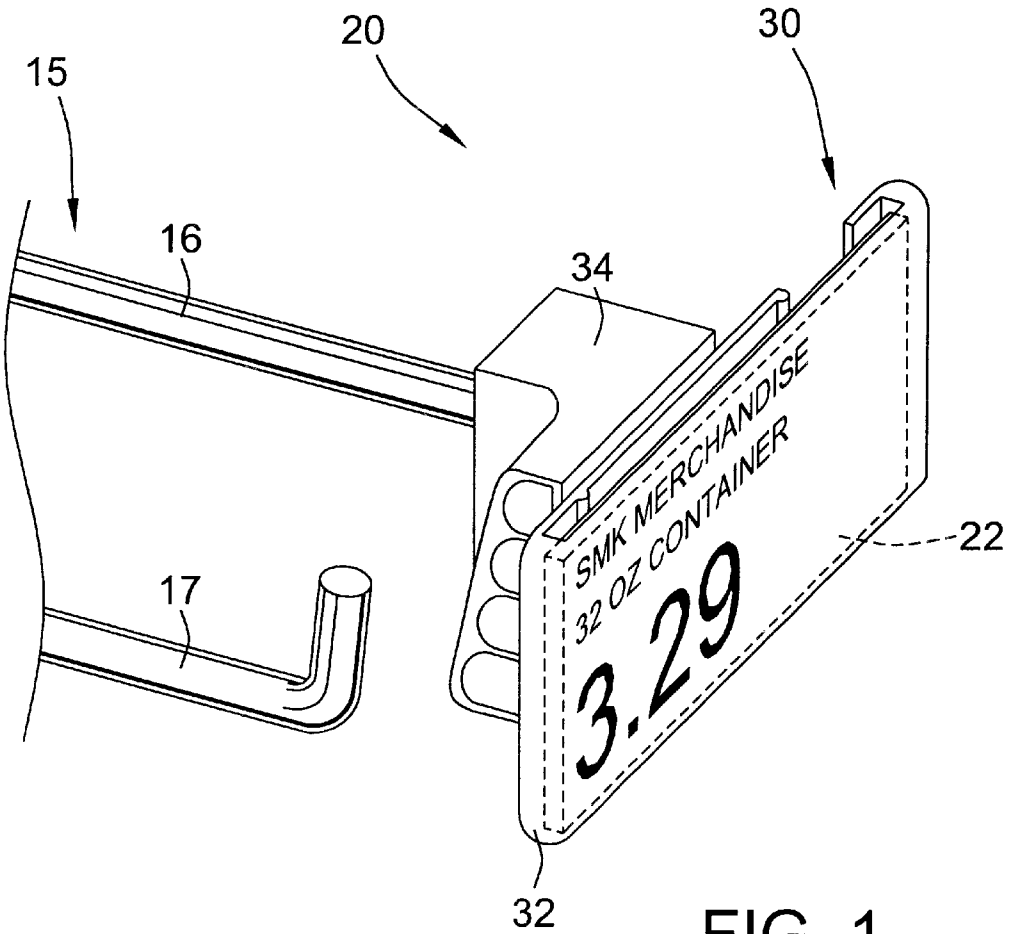
FIGS. 1 through 3 are perspective views of an embodiment of the product information display apparatus constructed in accordance with the teachings of the present invention illustrating a sign holder in various states of attachment to a label holder.
Figure 2:
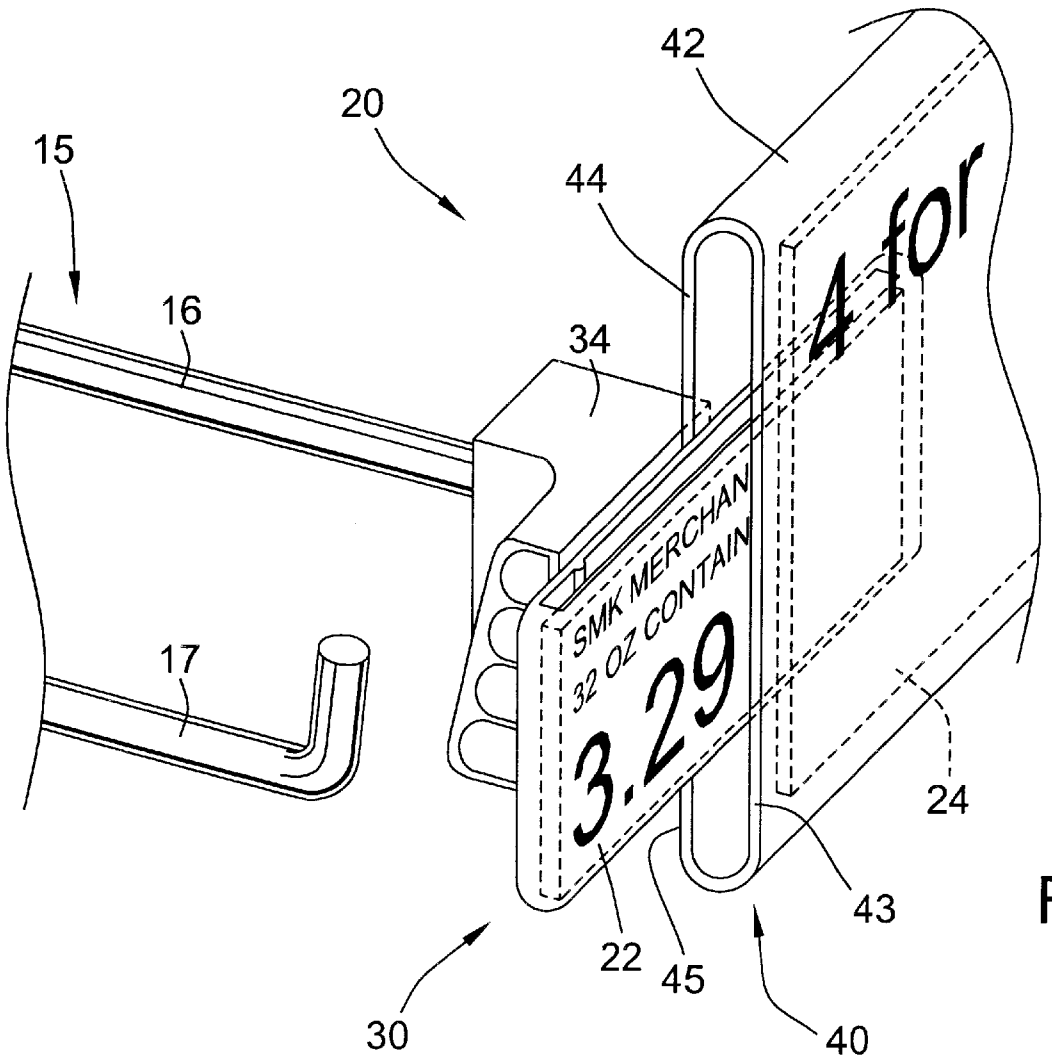
Figure 3:
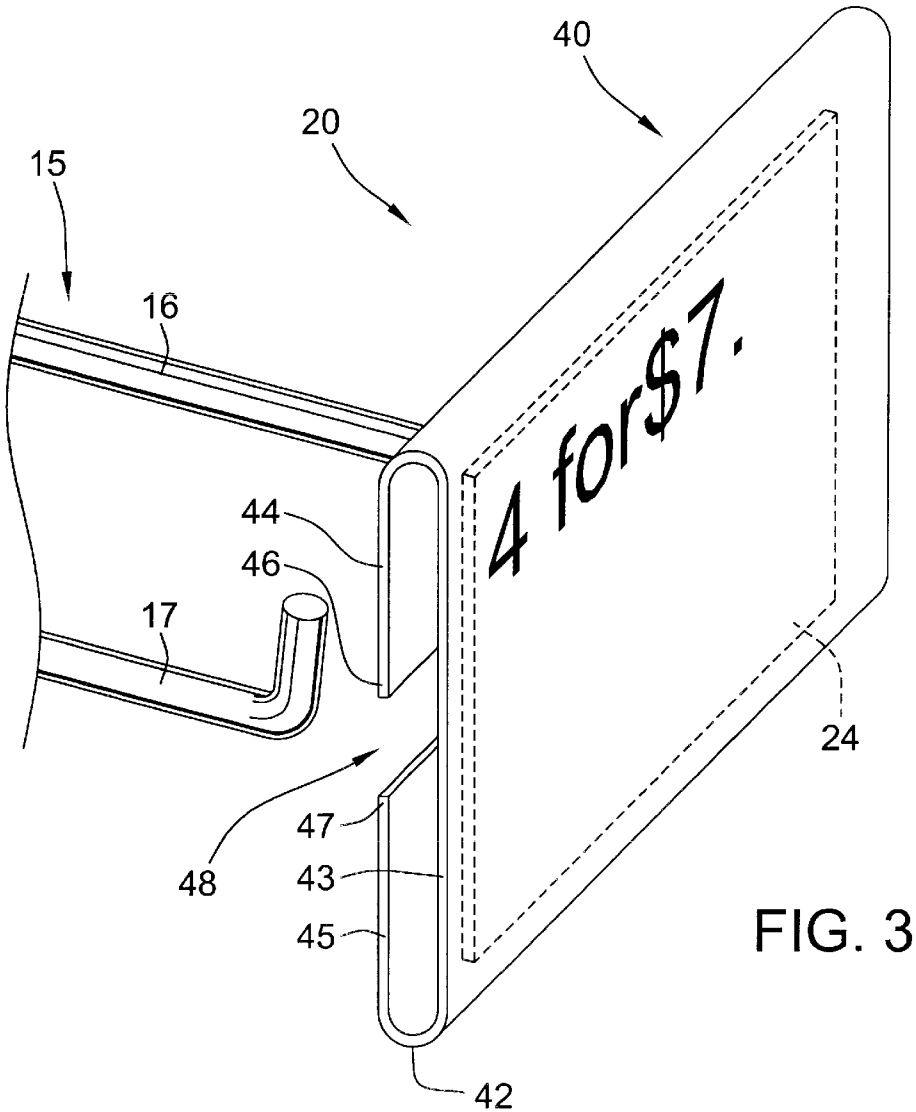

Referring now to the drawings, FIGS. 1 through 4 show a preferred embodiment of the present invention in various states of assembly. The product information display device 20 generally comprises a label holder 30 in a sign holder 40. As shown in FIGS. 1 through 3, the sign holder 40 is structured for selective attachment to the label holder 30 by sliding the sign holder 40 over the label holder 30 from a lateral side or end. The label holder 30 is adapted to hold a label 22 displaying primary product information such as name, size, price, etc. The sign holder 40 is adapted to carry a sign 24 for displaying supplementary or secondary information such as a special sale or the like.

The label holder 30 of the present invention generally comprises a sleeve 32 and a mounting member 34. The mounting member is structured for attachment to a merchandising support, which in the illustrated embodiment comprises a scanning hook 15 having an upper arm 16 and a lower arm 17. The upper arm 16 supports the product information display apparatus 20, while the lower arm 17 supports merchandise (not shown) suspended in a generally vertical position. The specific structure of the mounting member 34 shall be described later herein in accordance with a unique embodiment of the present invention. However, it will be recognized that the mounting member 34, while depicted as structured for attachment to a scanning hook, can be any type of mounting member that is well known in the art for attachment to any corresponding merchandise support such as shelves, grids, wire baskets, and other hangers or hooks such as peg hooks, loop hooks, J-hooks, and crossbar hooks.

Figure 6:
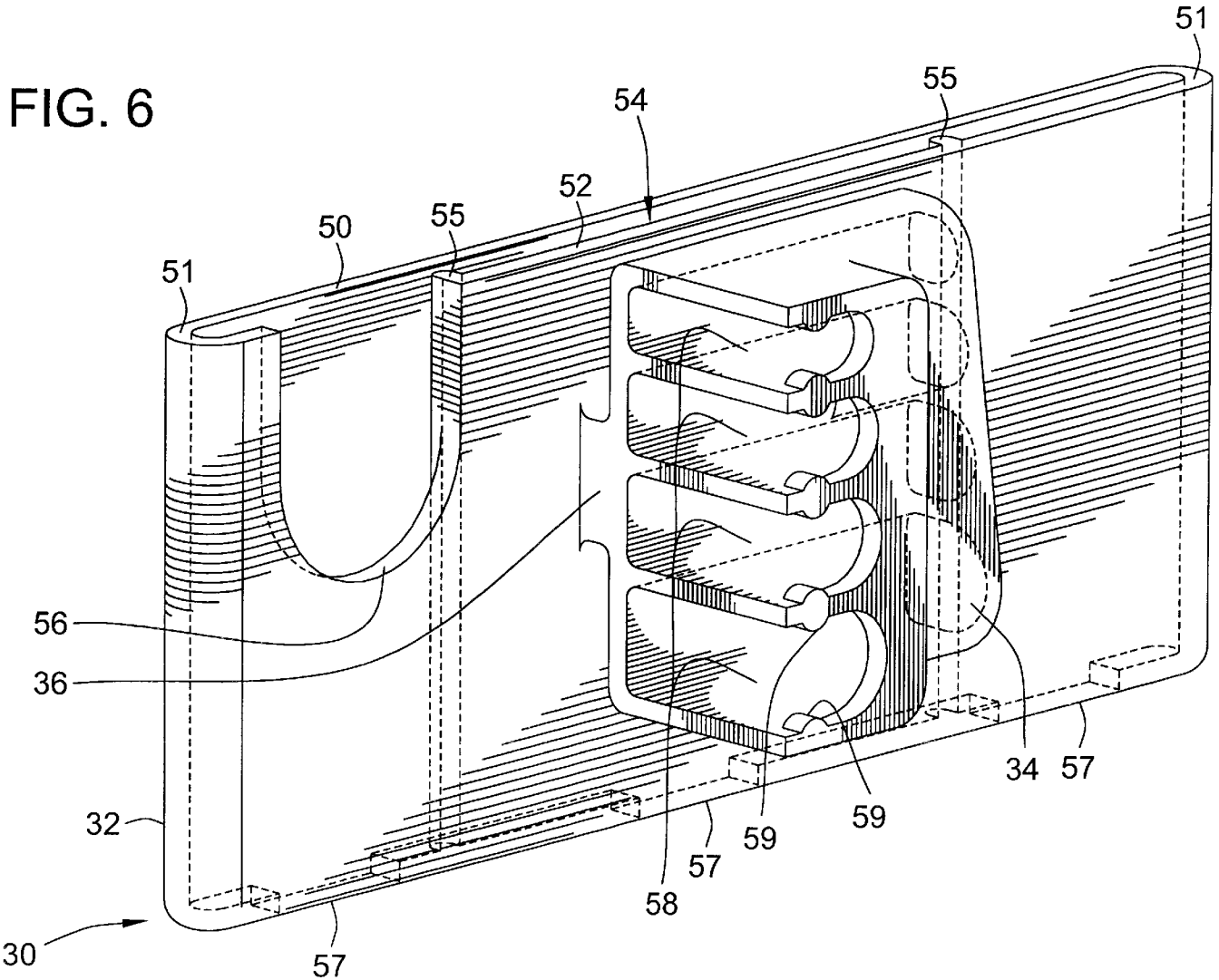
FIG. 6 is a perspective view, taken from the rear, of a label holder constructed in accordance with the teachings of the present invention.
Figure 7:
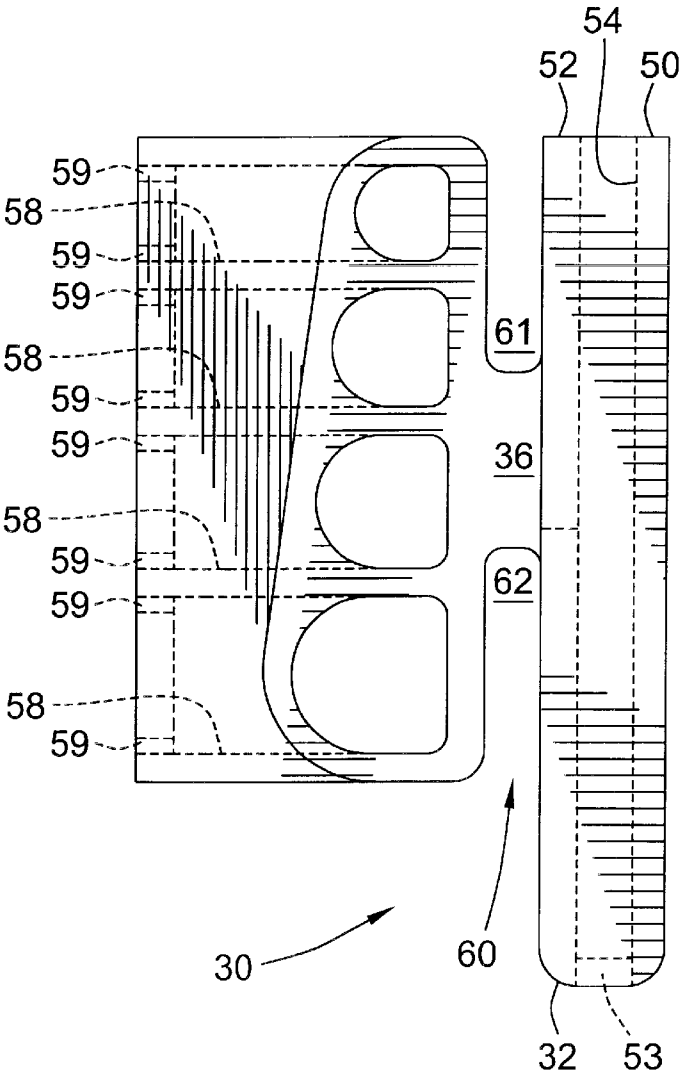
FIG. 7 is a side view of the label holder of FIG. 6.
Figure 8:
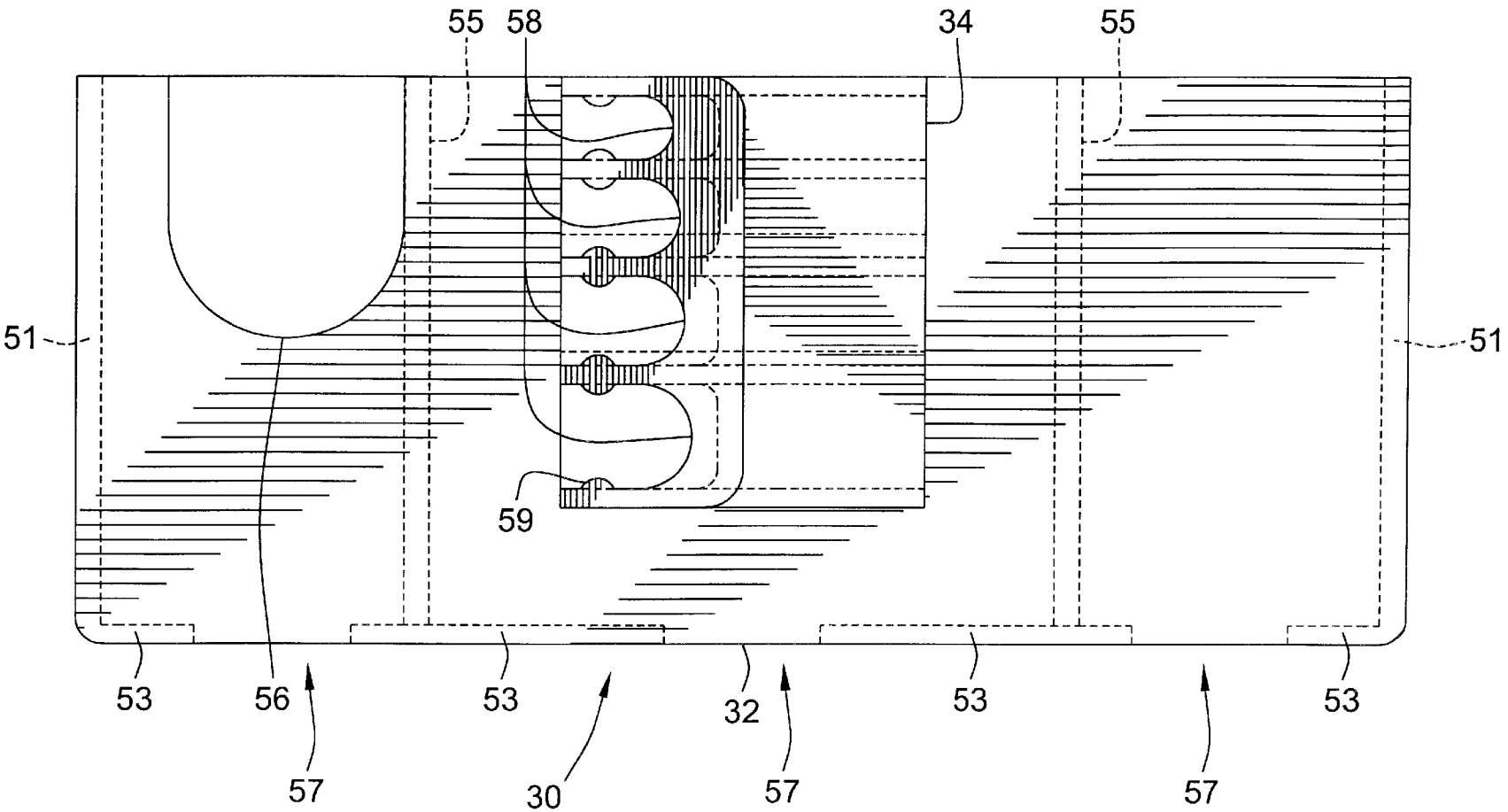
FIG. 8 is a rear view of the label holder of FIG. 6.
Figure 9:
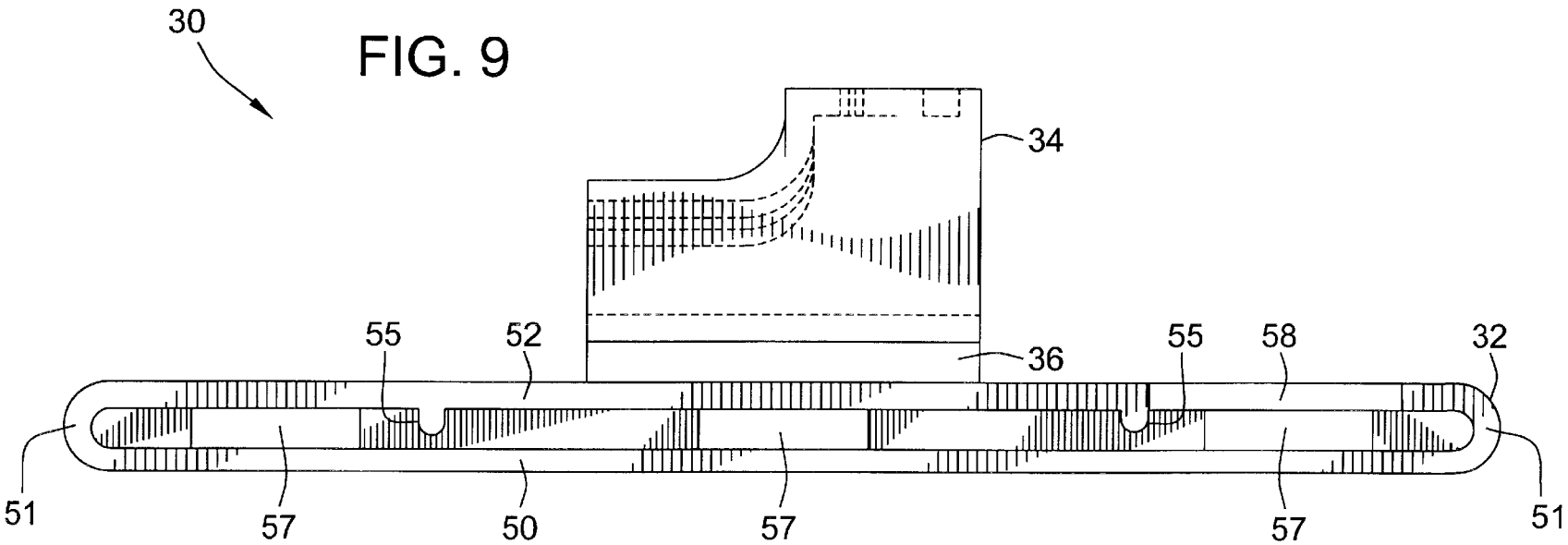
FIG. 9 is a top view of the label holder of FIG. 6.

The sleeve 32 includes an interior pocket 54 (FIG. 4) defined by front and rear walls 50, 52 (FIGS. 6 and 7). The front and rear walls 50, 52 define a height of the sleeve 32, and are horizontally spaced apart to define a thickness of the sleeve 32. The sleeve 32 is typically of a greater height than the mounting member 34 to leave a rearwardly facing surface of the rear wall 52 exposed. The sign holder 40 is structured to engage this rear surface when mounted, as will be discussed infra. Put another way, the sleeve 32 and mounting member 34 define a clearance for receiving the sign holder 40.

Figure 4:
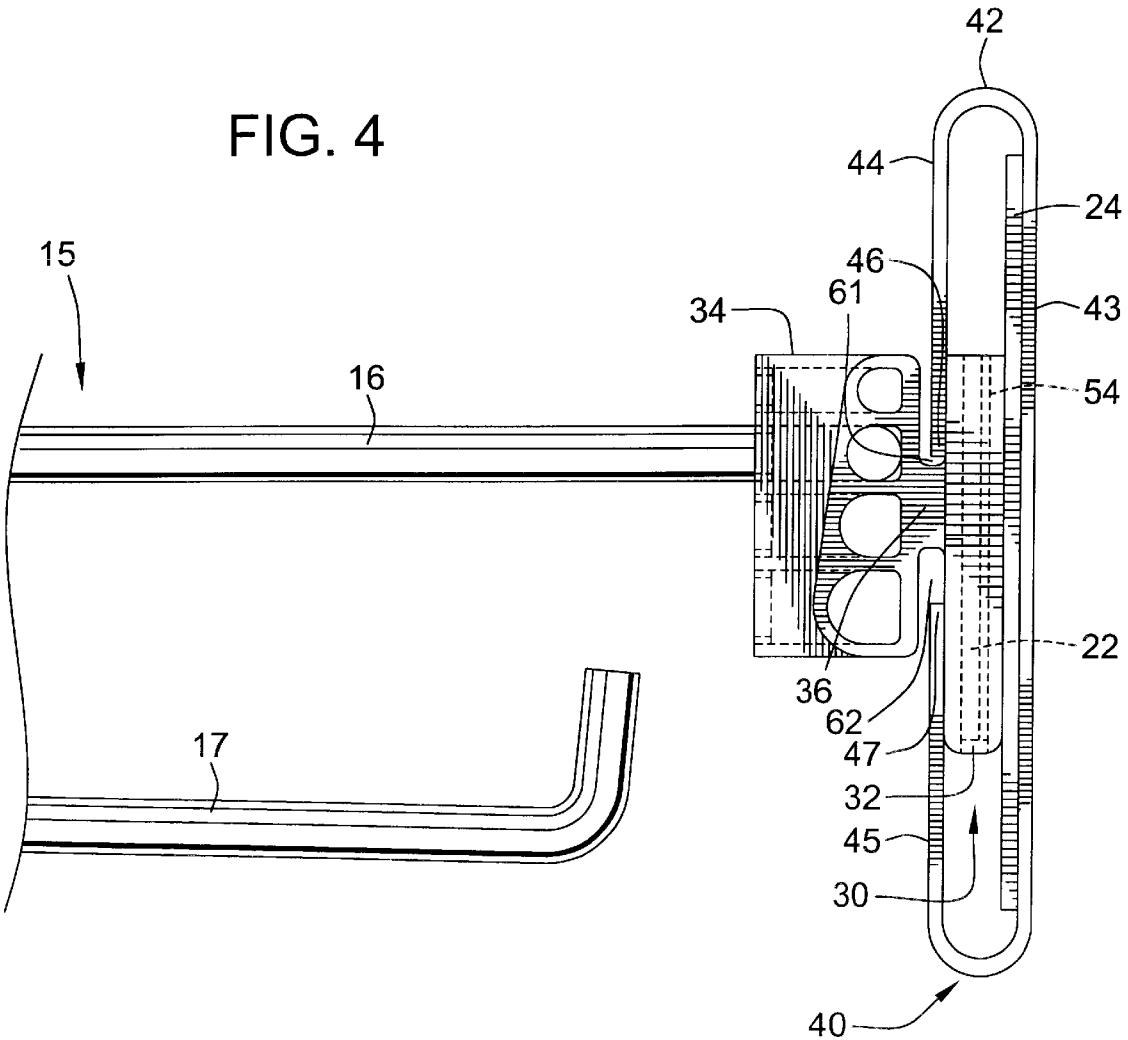
FIG. 4 is a side view of the product information display apparatus depicted in FIG. 3.
Figure 5:
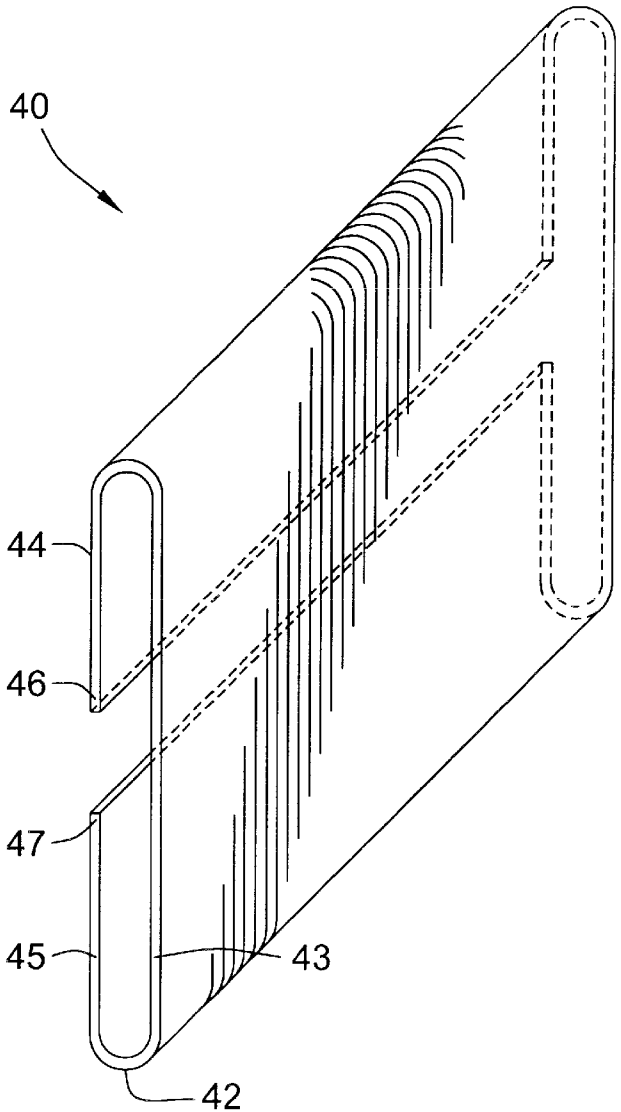
FIG. 5 is a perspective view, taken from the front, of a sign holder constructed in accordance with the teachings of the present invention.

As shown best in FIGS. 3 through 5, the sign holder is a generally C-shaped member 42 defined generally by a pair of rear walls 44, 45 connected by a front wall 43. Preferably, the sign holder 40 is constructed of a resilient plastic that is flexible yet fairly rigid, and is translucent, such as Butyrate. The rear walls 44, 45 are vertically spaced from each other, and their free ends 46, 47 define a throat 48 for receiving the label holder 30. Preferably, the rear walls 44, 45 are horizontally spaced from the front wall 43 a distance similar to the thickness of the sleeve 32. Preferably, the thickness of the sign 24 is also accommodated, although signs of different thicknesses may be used. Hence, the sign holder 40 is constructed of a material which provides some flexibility to ensure quick and secure mounting.

As shown in FIGS. 1 through 4, the label holder 30 will hold a label 22 having primary product information which is typically always displayed. This information may be changed by removing and replacing the label 22. When secondary or supplemental information is desired to be displayed, the sign holder 40 may be used to display such information on a sign 24. The sign 24 is inserted between the front and rear walls of the C-shaped member 42 and the sign holder 40 is laterally slid on the label holder 30 to substantially circumscribe the same. The throat 48 is sized to accommodate the label holder 30 such that the free ends 46, 47 of the rear walls 44, 45 may engage the rearwardly facing surface of the rear wall 52 of the sleeve 32. Likewise, the front wall 43 of the sign holder 40 sandwiches the sign 24 against the forwardly facing surface of the front wall 50 of the sleeve 32. The spacing of the rear walls 44, 45 and the front wall 43 ensures a tight fit on the label holder 30 to securely mount the sign holder 40 thereon. As shown in FIG. 3, the sign 24 may completely obscure the label 22, and hence the primary product information displayed thereon. Alternately, the sign 24 may leave a portion of its area blank or contain a window so that at least a portion of the label 22 may be viewed with the sign holder 40 in place. Therefore, it can be seen that either the primary product information or the secondary product information can be displayed individually, or alternately a combination of both information sources may be obtained in accordance with the teachings of the present invention.

In accordance with a preferred construction of the present invention, a bridge member 36 is positioned between the sleeve 32 and the mounting member 34 and links them together. The bridge 36 preferably has a height less than that of the mounting member 34 and the sleeve 32. As such, the bridge 36 defines a well between the sleeve 32 and mounting member 34, which in the illustrated embodiment includes an upper well 61 and a lower well 62. As best seen in FIG. 4, the well is sized to receive the free ends of the sign holder 40, and more particularly the upper well 61 is sized to receive the free end 46 of the upper rear wall 44, while the lower well 62 is sized to receive the free end 47 of the lower rear wall 45. It can be seen, and it will be readily understood, that the free ends 46, 47 need only to partially enter the wells 61, 62 to provide an additional security of attachment and to prevent the inadvertent removal of the sign holder 40. The wells 61, 62 will prevent the forward and rearward movement of the rear walls 44, 45, while they are laterally opening to facilitate the lateral sliding of the sign holder 40 and its attachment to and detachment from the label holder 30.

Turning now to FIGS. 6 through 9, a preferred construction of the label holder 30 is illustrated. As previously discussed, the label holder 30 generally comprises a sleeve 32 and a mounting member 34. The sleeve 32 includes horizontally spaced front and rear walls 50, 52 which define an interior pocket 54 sized to receive a label 22 (FIGS. 1 and 2). The sleeve 23 in the depicted embodiment is upwardly opening, and the rear wall 52 includes an upwardly opening slot 56 to assist inserting and removing a label.

Alternatively, the sleeve 32 may be laterally opening on either side of the sleeve and the rear wall 52 will then include a corresponding laterally opening slot to facilitate insertion and removal. The sleeve 32 also includes side walls 51 and a segmented bottom wall 53. The bottom wall 53 is segmented to define a plurality of openings 57 (FIG. 9) and the bottom of the label holder 32 to allow debris to fall therethrough. The rear wall 52 also includes at least one tab 55, two in the illustrated embodiment, projecting inwardly from an inner surface into the interior pocket 54. The projections or tabs 55 serve to securely position the label 24 within the label holder and prevent deformation of the label.

As can also be seen in the FIGS. 6–9, the mounting member 34 includes a plurality of slots 58 sized to receive the merchandise support, which in this case is a scanning hook 15 having an upper arm 16 with a laterally bent end as shown in FIGS. 1–3. The plurality of slots 58 are differently sized, each for a particular wire size corresponding to standard diameter sizes in the industry including but not limited to sizes such as 0.149, 0.186, 0.212, and 0.250 inches. It will also be recognized that the sleeve 32 of the label holder can be sized for any size label, including standard sizes such as 1.25 inches by 2 inches and 1.25 inches by 3 inches. The slots 58 are preferably vertically spaced or stacked atop one another according to size and in incremental order. The slots 58 are preferably L-shaped to correspond with the bent end of the arm 16. The rearwardly facing entrance of each slot 58 preferably includes a pair of bosses 59 (FIGS. 5, 6 and 8) to provide a snap-fit for a reliable and secure connection to the merchandise support.

Also as previously discussed, a bridge 36 preferably links the sleeve 32 to the mounting member 34. The bridge 36 is of a height smaller than both the mounting member 34 and the sleeve 32. The bridge 36 therefore defines a well, and more particularly an upper well 61 and lower well 62 (FIG. 7) which is sized to receive the free ends 46, 47 of the sign holder 40 as previously described. It will be readily understood that while the bridge 36 is not necessary, the mounting member 34 and sleeve 32 must define a clearance for the sign holder 40, and more particularly upper and lower rear surfaces of the rear wall 52 must be exposed for engagement with the rear walls 44, 45 of the sign holder 40.

However, it has been found that the wells are preferable as they assist and guide the sign holder 40 as it is attached to or removed from the label holder 30, and also prevent inadvertent removal of the sign holder.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A product information display apparatus for use with a merchandise support to display primary and secondary product information, the display apparatus comprising:

a label holder comprising, a sleeve having front and rear walls defining an interior pocket sized to receive a label having primary product information, and a mounting member connected to the rear wall of the sleeve, the mounting member structured for attachment to the merchandise support; and a sign holder structured for selective attachment to the label holder to position a sign adjacent the front wall of the sleeve, the sign having secondary product information;

a bridge linking the label holder and mounting member, the bridge, the label holder, and the mounting member defining an upper well and a lower well, the sign holder having a general C-shape, free ends of the C-shape defining a throat, the C-shape of the sign holder being defined upper and lower rear walls connected by a front wall, the upper well receiving the free end of the upper rear wall and the lower well receiving the free end of the lower rear wall.

2. The display apparatus of claim 1, wherein the throat is sized smaller than a height of the sleeve.

3. The display apparatus of claim 2, wherein free ends of the upper and lower rear walls are spaced apart to define the throat.

4. The display apparatus of claim 1, wherein the front wall is spaced from the pair of rear walls a distance approximately equal to a thickness of the sleeve.

5. The display apparatus of claim 1, wherein the bridge height has a height less than the mounting member and the sleeve.

6. The display apparatus of claim 1, wherein the upper well and the lower well is sized to receive the sign holder.

7. A label holder for use with a merchandise support to display a label having product information, the label holder comprising:

a sleeve having front and rear walls defining an interior pocket sized to receive a label;

a mounting member attached to the rear wall of the sleeve, the mounting member structured for attachment to the merchandise support; and a bridge linking the label holder and mounting member, the bridge having a height less than the mounting member and sleeve, the bridge, the label holder, and the mounting member defining an upper well and a lower well, the sign holder having a general C-shape, free ends of the C-shape defining a throat, the C-shape of the sign holder being defined by upper and lower rear walls connected by a front wall, the upper well receiving the free end of the upper rear wall and the lower well receiving the free end of the lower rear wall.

8. The display apparatus of claim 7, wherein the mounting member includes a plurality of slots, each slot of a different size to accommodate differently sized merchandise supports.

9. The display apparatus of claim 8, wherein each slot is generally L-shaped.

10. The display apparatus of claim 9, wherein the plurality of slots are vertically spaced in incremental size.

11. The display apparatus of claim 7, wherein the interior pocket of the sleeve is upwardly opening and the rear wall includes an upwardly opening slot.

12. The display apparatus of claim 7, wherein the interior pocket of the sleeve laterally opening and the rear wall includes a laterally opening slot.

* * * * *